United States Patent [19]

Larson

[11] 4,076,139

[45] Feb. 28, 1978

[54] INSULATED BOTTLE CONTAINER HAVING A BOTTLE SUPPORT AS ONE PART

[76] Inventor: Scott E. Larson, 313 Riverwoods Lane, Burnsville, Minn. 55337

[21] Appl. No.: 696,696

[22] Filed: Jun. 16, 1976

Related U.S. Application Data

[63] Continuation-in-part of Ser. No. 596,468, July 16, 1975, abandoned.

[51] Int. Cl.[2] ..... A61J 9/00

[52] U.S. Cl. ..... 215/11 C; 220/69; 215/13 R

[58] Field of Search ..... 220/66, 69, 70; 215/11 C, 12 R, 13 R

[56] References Cited

U.S. PATENT DOCUMENTS

| | | | |
|---|---|---|---|
| 2,808,167 | 10/1957 | Polazzolo | 215/13 R |
| 2,889,065 | 6/1959 | Lawlor | 215/12 R |
| 3,120,319 | 2/1964 | Buddrus | 215/13 R |
| 3,779,298 | 12/1973 | Piccirilli | 215/13 R |
| 3,986,610 | 10/1976 | Hawn | 215/12 R |

*Primary Examiner*—R. E. Hart

*Attorney, Agent, or Firm*—Richard Francis

[57] ABSTRACT

A thermal insulating container which comprises a cup-shaped cover member and a cup-shaped base member which telescope together to form a structure which has a central cavity which will accommodate a liquid containing bottle such as a baby bottle. The base is flat on one end and open on the opposite end to define a cavity adapted to accommodate and frictionally engage up to one half the length of the bottom portion of the bottle and to hold the same in upright position. The cover is open on one end to define a cavity which accommodates the remainder of the bottle. The cover cavity has a diameter slightly larger than the diameter of the bottle so that when the cover is disengaged from an erect base, the bottle remains in an upright position in the base which provides a bottle support. The base may be weighted to prevent tipping.

8 Claims, 2 Drawing Figures

INSULATED BOTTLE CONTAINER HAVING A BOTTLE SUPPORT AS ONE PART

This application is a continuation-in-part of my prior copending application Ser. No. 596,468, filed July 16, 1975 now abandon.

This invention relates to an insulating container for storing a bottle containing fluid at a predetermined temperature. More particularly, the invention relates to such a container which provides, as one part thereof, a support for frictionally holding such a bottle in an upright position.

Often persons with small babies that require feeding from a bottle find it difficult, if not impossible, to heat the milk, formula or other liquid food contained therein while they are traveling. Many attempts have been made to provide devices for heating baby bottles during travel but such devices are generally impractical and awkward to use as well as being quite expensive. Many require electrical parts or the addition of heated liquids such as hot water to heat the contents of the bottle. For example, Widener, U.S. Pat. No. 3,155,260, discloses an insulating jacket which has a space between the bottle wall and the inner wall of the jacket for containing a heated liquid. Such an air gap would tend to lessen the insulating value of the container. Filling the air gap with heated liquid creates a dangerous condition both for the person filling it and for the baby who will be nearby. Additionally, Widener's jacket encompasses nearly all of the bottle, making it difficult to extract when feeding time occurs.

Others have disclosed insulated devices for containing previously heated filled baby bottles, but such devices are either easily broken, inefficient, difficult to use, or have a combination of one or more of these problems. As a typical example, Polazzolo, U.S. Pat. No. 2,808,167, discloses an insulated container for a baby bottle which employs an evacuated glass sleeve typically found in "Thermos" type vaccum bottles. Such sleeves are known to be extremely fragile and easily broken. Gauthier, U.S. Pat. No. 2,759,617, discloses a baby bottle container which has an insulated foam rubber sleeve and a sack-like top which could cause difficulty in removing the bottle for feeding.

The present invention provides a novel thermal insulating container which avoids the problems noted above. The container of the invention is inexpensive to manufacture because of its simple design and it is extremely easy to use.

SUMMARY OF THE PRESENT INVENTION

The container of the invention comprises a cup-shaped cover member and a cup-shaped base member which telescope together to define a structure having an internal cavity which will accommodate a liquid-containing vessel such as a baby bottle. The cover and the base may be formed of insulating material such as expanded polystyrene or of any moldable plastic material which, besides providing the necessary insulation, provides a shock-resistant leak-proof envelope about the bottle. The base has a flat bottom which permits it to be supported on any flat surface such as a kitchen countertop or an automobile seat, providing a tip-resistant support for holding the bottle in an upright position to permit filling and easy access.

The cavity of the base has a depth which will accommodate up to one-half the length of the bottle, leaving exposed the upper half of the bottle for easy grasping and removal. The base cavity has a diameter generally equal to that of the bottle to provide frictional engagement therewith. The cap has a cavity which will accommodate the remainder of the bottle. The diameter of the cover cavity is slightly larger than the diameter of the bottle so that, as the cover is separated from the base, the bottle remains in the base. Preferably the base member cavity accommodates from one-fourth to one-half the length of the bottle.

A further advantage is provided by having at least half of the bottle exposed by the base and frictional engagement of the bottle within the cavity of the base. The combined bottle and base may be used to bottle feed the baby in a crib or other area without having to further support the bottle such as by a folded towel. This type of bottle feeding is oftentimes done by busy mothers who do not have time to hold the baby for feeding after the baby is of a sufficient age. Placing the bottle on a folded towel is not desirable because the bottle usually easily rolls from this type of support, causing the liquid to go to the base of the bottle and the base of the bottle to go to a point lower than the baby's mouth. Such a development causes the baby to ingest undesirable amounts of air which in turn produces further well known problems.

DRAWING

The invention is further illustrated with reference to the drawing wherein.

DETAILED DESCRIPTION OF THE PRESENTLY PREFERRED EMBODIMENTS

Figure 1:
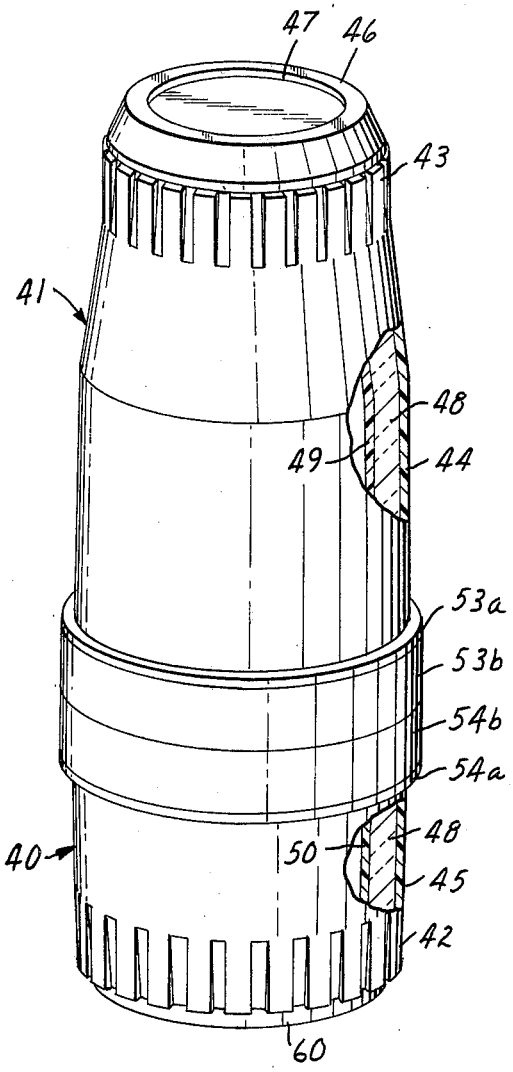
FIG. 1 is yet another embodiment of a container in accordance with the invention shown in perspective view with portions shown cut away and in section.

FIG. 1 depicts the preferred embodiment of a container in accordance with the invention which container comprises base member 40 and cap member 41 which telescope together. Base member 40 has a flat bottom end 101 and an opening at the opposite end to define an internal cavity. The base member 40 cavity is defined by having substantially cylindrical sidewalls 102 and inner end surface 103 which preferably corresponds substantially to the base or bottom of a baby bottle to be inserted therein. The diameter of the base member cavity is approximately equal to the outer diameter of baby bottle 100 to be inserted therein, providing frictional engagement between base member and the baby bottle when it is so inserted. The depth of base member cavity, i.e., the vertical distance between surface 103 and the upper end of base member 40, will be no greater than one-half the total length of baby bottle 100 so that at least one-half the length of the baby bottle is always exposed for ease of removing the bottle.

Cover member 41 has a cylindrical cavity which is coaxial with and slightly larger in diameter than the cavity of base 40. Cover cavity is defined by having cylindrical sidewalls 104, which may be tapered as shown, and an inner end surface 105 which preferably corresponds generally to the top of a baby bottle. Surface 105 may conform to an end of baby bottle fitted with a nipple for feeding or may conform to the closed end of a baby bottle having a nipple held in inverted position by a cover 21 for storage (as shown). The diameter of the cover cavity is slightly larger than the diameter of baby bottle 100 that will be inserted therein so that the cover member 41 may be easily disengaged with no frictional restraint between it and the bottle.

The base member 40 and the cover member 41 have mating end portions that are shaped to engageably telescope together. The mating ends are preferably threaded to provide for more positive engagement of the cover and the base.

It should be noted that mating ends of the cover and body members may be reversed for the respective parts. That is, base member 40 could have a mating end shaped as shown for cover member 41 and cover member 41 could have a mating end as shown for base member 40. Preferably, the frictional engagement is such that one may hold the container with a filled bottle therein by cover member 41 with base member 40 depending therefrom and not have the parts separate.

The wall thickness of the container of the invention is sufficient to provide a low rate of heat exchange between the interior of the container and the surrounding atmosphere. For this purpose, wall thicknesses varying between one-half inch and two inches will be found to be acceptable.

The cover members and base members described will be formed of any suitable rigid insulating material which is preferably water impervious or may be rendered so by surface coating. The preferred insulating material is expanded polystyrene such as that sold under the commercial designation "Dylite" or expanded polyurethane. Expanded polystyrene and expanded polurethane have very low thermal coefficients and low specific heats which makes them excellent insulating materials for the container of the invention.

The base member of the container of the invention is preferably weighted to prevent tipping by insertion of a weight within a suitable cavity adjacent its bottom surface. This weight may be a piece of metal such as iron or it may be a permanent magnet, providing a magnetic surface to the bottom of the base member to give even more resistance against tipping when base member 40 is supported by a magnetically susceptible surface such as that of a stove.

The cover members and base members described above are prepared by utilizing conventional molding techniques with molds which have cavities which are the counterparts of the cover members and base members described above. The preferred molding methods involve so-called closed mold techniques or injection or extrusion molding techniques.

Thermoplastic resin beads, e.g., polystyrene mixed with about 6–8% blowing agent such as m-pentane, are typically used in closed molding processes. A measured quantity of beads is charged into the mold cavity which is thereafter closed and then heat with low pressure steam is applied. Heating is continued until the beads expand and coalesce to form an integral part. The mold is then cooled and the part removed.

Plastic coatings may be applied to the molded parts by way of a variety of known techniques. The preferred methods involve either spraying or dipping the part with either molten plastic material or a solvent solution or emulsion of the plastic material which will become the coating. A preformed sleeve of the coating material may also be fastened to the surface of the insulating part.

Figure 2:
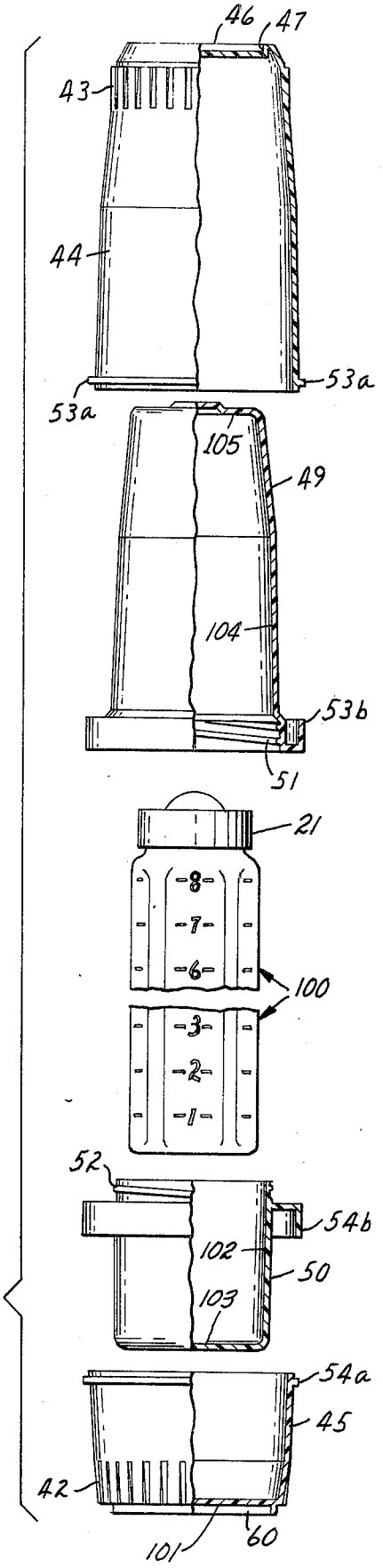
FIG. 2 is an exploded perspective view of the container shown in FIG. 1 with portions shown cut away and in section.

FIGS. 1 and 2 depict the preferred embodiment of the insulated bottle container of the invention which comprises cover member 41 and base member 40 which telescope together to form a structure having a cavity which will accommodate baby bottle 100. Cover member 41 is formed of outer cup-shaped member 44 and inner cup-shaped member 49 which are adapted to telescope together. Outer cup-shaped member 44 has at its open end a peripheral ridge **53*a* which is adapted to engage with mating flange member 53*b* at the mouth of inner cup-shaped member 49 to form cover member 41 having a space between the inner wall and outer wall. Flange member 53*b* has a portion projecting toward the closed end of inner cup-shaped member 49 and spaced from its outer surface to provide an annular socket for receiving and engaging the open end of outer cup-shaped member 44 with ridge 53*a* abutting the end surface of the projecting portion of flange member 53*b*. Similarly, base member 40 is comprised of inner cup-shaped member 50 and outer cup-shaped member 45 which have mating parts 54*b* and 54*a*, respectively. To complete assembly, adhesive may be employed to cement the mating surfaces together or they may be welded, for example, by ultrasonic welding, to permanently fasten the parts together. Cover member 41 has inner threaded portion 51 adjacent its open end capable of engaging outer threaded portion 52 adjacent the opening of base member 40** such that these parts may be securely engaged by turning the threaded parts together.

The parts of the insulated bottle container of the invention depicted in FIGS. 1 and 2 as described above may be utilized without having insulating material within the spaces between the walls of the parts forming the cover member, the air space providing the insulation, or insulating material 48 may be included in this space. The insulating material 48 may be in the form of a preformed cup-shaped structure capable of fitting in this space which may be inserted when the parts of the container are assembled. Alternatively, insulating material 48 may be provided by injecting a foaming liquid which will foam and cure to form a solid foam after the parts have been welded or adhesively bonded together. Foaming liquids of this type which will cure to foam solid foamed insulation are well known. A preferred foam which can be prepared in this manner is comprised of polyurethane resin.

End portion of cover member 41 preferably is flattened having a raised annular rib 47 to form a ring-like structure 46 having a constricted opening such that a disclike member may be inserted and retained within the annular ring. Such a disc-like member may bear the name or photograph of the baby who would use the bottle contained therein or may contain the manufacturer's logo. The bottom end of the container of the invention may have a similar raised annular rib 60 to support the bottle on a flat surface.

Preferably the edges of the top and the bottom of the container are ribbed or otherwise roughened at surfaces 43 and 42, respectively, to provide a grasping surface to more conveniently disengage the parts.

While the general tenor of the application has been directed to describing the container of the invention for insulating a baby bottle containing heated liquid, the container may also be used to contain and insulate a bottle containing chilled liquid. The container of the invention may be used to hold and insulate a bottle of chilled liquid such as milk for a long period of time, e.g., up to several hours with little decrease in temperature over this period.

Modifications in the invention may be made without departing from the scope of the claims. For example, a fastening means may be added to the embodiments depicted in FIGS. 1-2 to provide more positive attachment between the cover member and the base member. Such fastening means may be in the form of a strap which is permanently fastened to either the base or the cover and removably fastened to the other part or by means of a fastening material such as that sold under the trade designation "Velcro". The latter utilizes a fabric strip which may be fastened to one part and a strip bearing hooked plastic barbs which strip may be fastened to the other part. Further modification of the container is also possible without departing from the claims.

What is claimed is:

1. A thermal-insulating container particularly adapted to completely contain an elongate vessel such as a baby bottle containing liquid at a predetermined temperature, said container comprising a cup-shaped base member and a cup-shaped cover member having mating portions adapted to be engageable secured together, said members being formed of a thermally insulating material and when secured together defining a generally cylindrical central cavity, said base member having a bottom end capable of supporting said container in an upright position and being open on the opposite end to define a cavity having a depth corresponding to no more than about one-half the length of a said vessel and being dimensioned to provide a frictional fit therewith, and an inner end surface corresponding generally to the shape of the base of a said vessel, said cover member cavity having a depth sufficient to contain that portion of a said vessel not contained in said base member cavity, a diameter slightly larger than the diameter of a said vessel and an inner end surface corresponding generally to the shape of the top surface of a said vessel wherein each of said cover member and said base member is formed of a cup-shaped outer member and a cup-shaped inner member one of said cup-shaped outer member and said cup-shaped inner member having a peripheral ridge at its open end and the other of said cup-shaped outer member and said cup-shaped inner member having a flange member at its open end, a said flange member having a portion projecting toward the closed end of the member with which it is associated and spaced from its outer surface providing an annular socket for receiving and engaging the open end of the other of said outer or inner members with said ridge abutting and in engaged relationship with the projecting portion of said flange member to provide said cover and base members having cavities between their inner walls and their outer walls.

2. The thermal-insulating container of claim 1 wherein said base member includes a weight adjacent its bottom surface.

3. The thermal-insulating container of claim 2 wherein said weight is a magnet.

4. The containeı of claim 1 wherein said cavities are filled with cellular insulating material.

5. The container of claim 4 wherein said cellular insulating material is selected from a group consisting of expanded polystyrene and expanded polyurethane.

6. The container of claim 1 in combination with a baby bottle contained within said cavity.

7. The container of claim 1 wherein said cover member and said base member are threaded on their mating ends.

8. The container of claim 1 wherein said cover member includes a raised annular rib on its closed outside end capable of retaining a disc therein.

* * * * *